US010132008B2

(12) United States Patent
Mizuno et al.

(10) Patent No.: US 10,132,008 B2
(45) Date of Patent: Nov. 20, 2018

(54) HORIZONTAL HEAT TREATMENT DEVICE

(71) Applicant: Mitsubishi Rayon Co., Ltd., Tokyo (JP)

(72) Inventors: Keishi Mizuno, Hiroshima (JP); Tetsu Yasunami, Aichi (JP); Atsushi Kawamura, Hiroshima (JP); Youji Hatanaka, Hiroshima (JP); Nobuyuki Yamamoto, Aichi (JP); Hiromasa Inada, Hiroshima (JP)

(73) Assignee: Mitsubishi Chemical Corporation, Tokyo (JP)

( * ) Notice: Subject to any disclaimer, the term of this patent is extended or adjusted under 35 U.S.C. 154(b) by 438 days.

(21) Appl. No.: 14/376,979

(22) PCT Filed: Feb. 7, 2013

(86) PCT No.: PCT/JP2013/052883
§ 371 (c)(1),
(2) Date: Aug. 6, 2014

(87) PCT Pub. No.: WO2013/118826
PCT Pub. Date: Aug. 15, 2013

(65) Prior Publication Data

US 2015/0299909 A1 Oct. 22, 2015

(30) Foreign Application Priority Data

Feb. 7, 2012 (JP) ..... 2012-024137

(51) Int. Cl.
*F27B 1/08* (2006.01)
*D01F 9/32* (2006.01)
(Continued)

(52) U.S. Cl.
CPC ..... *D01F 9/32* (2013.01); *D02J 13/001* (2013.01); *F27B 1/08* (2013.01); *F27B 9/04* (2013.01);
(Continued)

(58) Field of Classification Search
CPC .. F24F 2009/007; F24F 9/00; F24F 2009/005; D01F 9/32
(Continued)

(56) References Cited

U.S. PATENT DOCUMENTS 6,027,337 A 2/2000 Rogers et al.
2005/0115103 A1* 6/2005 Yamaguchi ..... D01F 9/32 34/580

FOREIGN PATENT DOCUMENTS

JP 2007-224432 A 9/2007
JP 2008-081859 A 4/2008
(Continued)

OTHER PUBLICATIONS

International Search Report issued in corresponding International Patent Application No. PCT/JP20131052883 dated Apr. 2, 2013.

*Primary Examiner* — Steven B McAllister
*Assistant Examiner* — John Bargero
(74) *Attorney, Agent, or Firm* — Morgan, Lewis & Bockius LLP

(57) ABSTRACT

A horizontal heat treatment device continuously subjects an untreated continuous flat object to heat treatment while horizontally transferring the untreated object within a heat treatment chamber. Seal chambers are interconnected to the untreated-object loading opening and treated-object unloading opening of the heat treatment chamber. A passage is connected to an opening of each of the seal chambers, the opening located on the side opposite the heat treatment chamber. The untreated-object passage loading opening
(Continued)

interconnected to the untreated-object seal chamber loading opening and the treated-object passage unloading opening interconnected to the treated-object seal chamber unloading opening are the untreated-object loading opening and treated-object unloading opening of the heat treatment device. A pair of gas ejection nozzles are provided at upper and lower positions of the passages. The nozzles eject gas in specific directions, and the nozzle openings have a specific shape, a direction, and a length.

16 Claims, 3 Drawing Sheets

(51) Int. Cl.

| | |
|---|---|
| ***F27D 99/00*** | (2010.01) |
| ***D02J 13/00*** | (2006.01) |
| ***F27B 9/04*** | (2006.01) |
| ***F27D 7/06*** | (2006.01) |
| *F27B 17/00* | (2006.01) |
| *F27B 9/38* | (2006.01) |

(52) U.S. Cl.
CPC ..... *F27D 7/06* (2013.01); *F27D 99/0075* (2013.01); *F27B 2009/382* (2013.01); *F27B 2009/384* (2013.01); *F27B 2017/0091* (2013.01)

(58) Field of Classification Search
USPC ..... 432/8; 34/580
See application file for complete search history.

(56) References Cited

FOREIGN PATENT DOCUMENTS

| | | | | |
|---|---|---|---|---|
| JP | 2008-156790 | A | 7/2008 | |
| WO | 2002/077337 | A1 | 10/2002 | |
| WO | WO 2011094615 | A2 * | 8/2011 | ..... F27B 9/28 |

* cited by examiner

[Fig. 1]
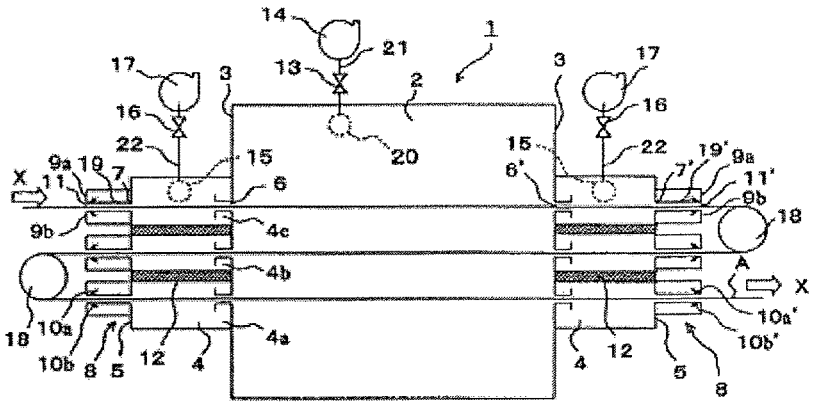
[Fig. 2]
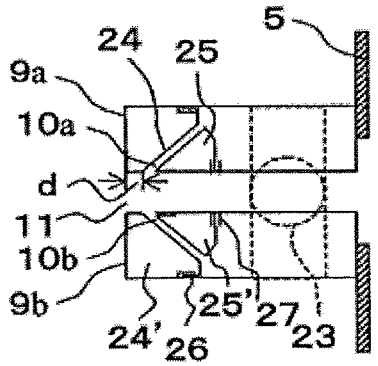
[Fig. 3]
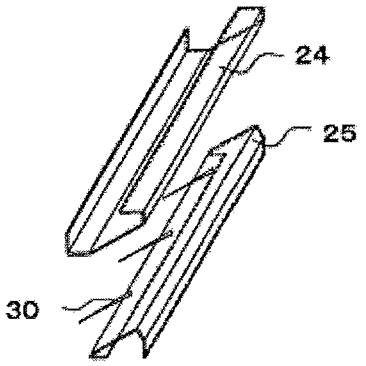

[Fig. 4]
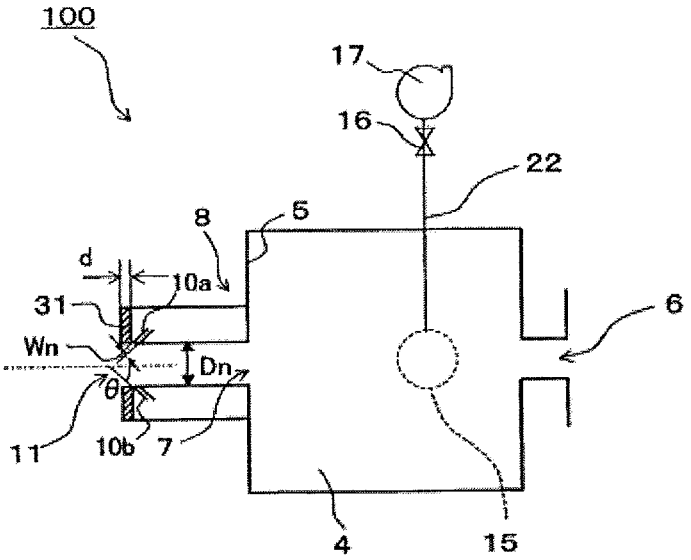
[Fig. 5]
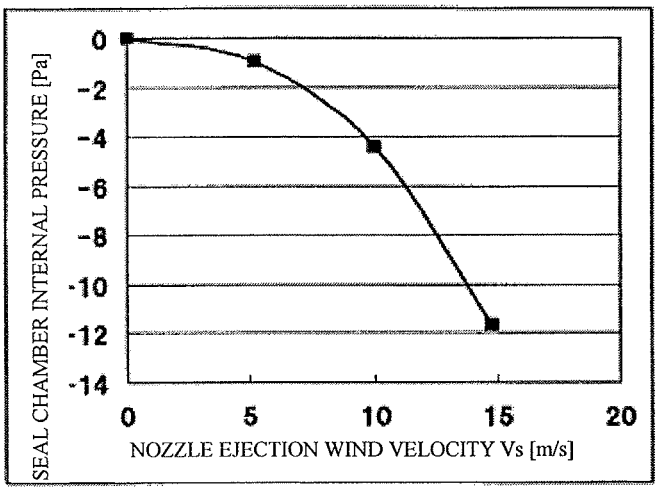

[Fig. 6]
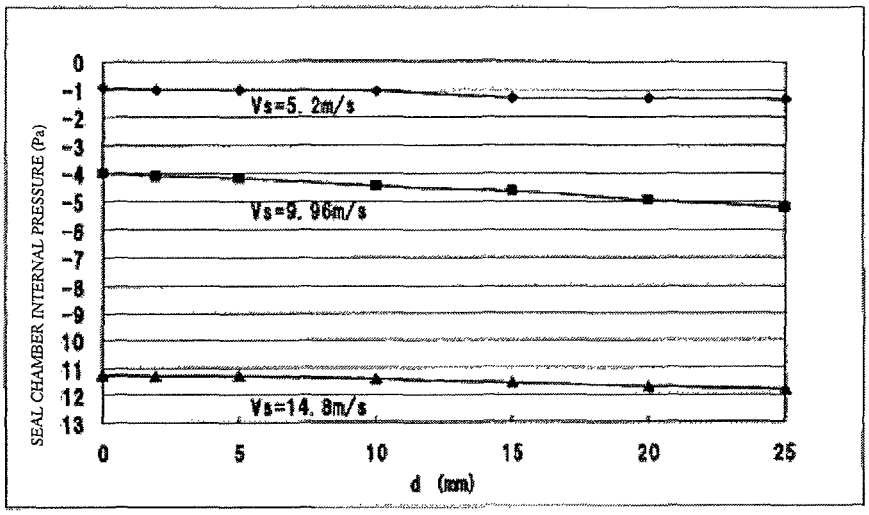
[Fig. 7]
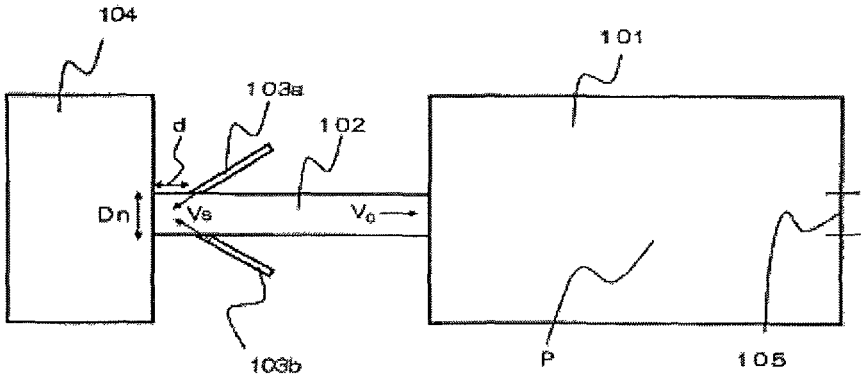

HORIZONTAL HEAT TREATMENT DEVICE

TECHNICAL FIELD

The present invention relates to a heat treatment device that can be suitably used in a oxidation oven for making a carbon fiber precursor fiber bundle have flame resistance.

BACKGROUND ART

In the past, in manufacturing of long objects such as a film, a sheet, and a fiber (hereinafter, referred to as an object), a heat treatment device configured to continuously heat-treat the object has been known. As an example of a case of carbon fiber, the heat treatment device continuously performs the heat treatment of the precursor fiber made of, for example, polyacrylonitrile fibers, within a heat treatment chamber. At this time, a cracked gas such as cyanide, ammonia, and carbon monoxide is generated in the heat treatment chamber by oxidation reaction of the precursor fiber. It is necessary to recover the cracked gas and perform a gas treatment such as a combustion treatment.

Patent Document 1 suggests a heat treatment device in which in order to prevent such a cracked gas from leaking to the outside of the heat treatment device from an loading opening/an unloading opening of the precursor fiber bundle of the heat treatment device, a seal chamber configured to set a negative pressure in the chamber and recover the cracked gas is provided near the heat treatment chamber, and an air curtain unit is provided which suppresses the inflow of outside air by blowing the air outside the heat treatment device toward the object on the outside of the loading opening/unloading opening of the precursor fiber bundle of the seal chamber, wherein a cylindrical rectifying member is provided in the seal chamber continuously provided to the heat treatment chamber so as to prevent the gas in the seal chamber from leaking to the outside even if the ejection velocity of the air blowing toward the object is increased.

In addition, a heat treatment device, in which in order to suppress a temperature variation in the heat treatment device, a slit is provided in the leading opening/unloading opening of the heat treatment device, and which is provided with a mechanism configured to eject the heated air to the inside of the heat treatment device or the outside of the heat treatment device from the slit, has been suggested (see, Patent Document 2).

In order to prevent the cracked gas from leaking to the outside of the heat treatment device from the loading opening/unloading opening of the precursor fiber bundle of the heat treatment device, a heat treatment device provided with an air curtain unit configured to suppress the inflow of outside air by blowing the air outside the heat treatment device toward the object on the outer side of the loading opening/unloading opening of the precursor fiber bundle has been suggested (see Patent Document 3).

CITATION LIST

Patent Document

Patent Document 1: JP 2008-156790 A
Patent Document 2: WO 02/077337
Patent Document 3: U.S. Pat. No. 6,027,337

DISCLOSURE OF THE INVENTION

Problem to be Solved by the Invention

In the heat treatment device disclosed in Patent Document 1, it was possible to prevent the leakage of the cracked gas to the outside of the heat treatment device body, even if increasing the ejection velocity of the air blowing toward the object, but since the seal chamber has the negative pressure, air ejected toward the object from the upper and lower air curtain nozzles is easily sucked into the seal chamber, and there has been a need to blow an amount of air curtain air blowing toward the object more than the required amount.

Accordingly, an object of the invention is to provide a heat treatment device capable of preventing the gas in the seal chamber such as the cracked gas from leaking to the outside, even if the amount of air curtain gas blowing toward the object is reduced.

Another object of the invention is to provide a method of manufacturing a flame-resistant fiber bundle using such a heat treatment device, a method of manufacturing a carbon fiber bundle, and a heat treatment method.

Means for Solving Problem

In accordance with an aspect of the invention, there is provided a horizontal heat treatment device that continuously heat-treats a continuous flat object, while transporting the object within a heat treatment chamber in a horizontal direction, wherein a seal chamber connected to an exhaust fan is connected to each of object loading opening and unloading opening of the heat treatment chamber, the seal chamber is configured so that the object can pass through the seal chamber in the horizontal direction, a passage having a rectangular cross-section is connected to an opening of the object loading opening and unloading opening of each seal chamber located on a side opposite to the heat treatment chamber, and the passage is configured so that the object can pass through the passage in the horizontal direction, the object loading opening of the passage connected to the seal chamber object loading opening is an object loading opening of the heat treatment device, and the object unloading opening of the passage connected to the seal chamber object unloading opening is an object unloading opening of the heat treatment device, a pair of nozzles configured to eject the gas is provided at upper and lower positions of each passage, a gas ejection opening of each nozzle has a rectangular shape, in each passage, the pair of nozzles provided in the passage ejects the gas toward a center in the vertical direction of the passage, and toward the object loading opening or the object unloading opening of the heat treatment device included in the passage, in each passage, the gas ejection opening of each nozzle provided in the passage is parallel to a long-side direction of the loading opening and the unloading opening of the object of the passage and has a length equal to a length of the long side, and in each passage, a distance d between the gas ejection opening of the pair of nozzles provided in the passage and the object loading opening or the object unloading opening of the heat treatment device included in the passage, and a height Dn of the passage satisfy a relation of $2 \leq d < 0.75$ Dn.

In each passage, it is preferred that the distance d be 15 mm or more.

In each passage, it is preferred that an opening width Wn of the nozzle be 0.5 mm or more and 3 mm or less, and the height Dn of the passage be 20 mm or more and 78 mm or less.

The passages are each provided at multiple positions in the vertical direction so that the object can be transported in the horizontal direction at the multiple positions in the vertical direction, respectively, and the seal chamber is partitioned so as to correspond to each of the passages.

It is preferred that the device have a gas flow rate control mechanism capable of adjusting an amount of ejection of gas for each nozzle.

The passage is formed by an upper passage member, a lower passage member, and a lateral surface member, each of the upper and lower passage members has two members with the nozzle interposed therebetween, and the two members can be integrated with a spacer member configured to determine a nozzle gap while interposing the spacer member therebetween.

It is preferred that the two members and the spacer member be freely attachable and detachable.

The horizontal heat treatment device may be a heat treatment furnace that heat-treats the carbon fiber precursor fiber bundle.

According to another aspect of the invention, there is provided a method of manufacturing a flame-resistant fiber bundle that heat-treats a carbon fiber precursor fiber bundle by a horizontal heat treatment device to manufacture the flame-resistant fiber bundle, wherein the horizontal heat treatment device is a horizontal heat treatment device that continuously heat-treats a continuous flat object, while transporting the object within a heat treatment chamber in a horizontal direction, a seal chamber connected to an exhaust fan is connected to each of object loading opening and unloading opening of the heat treatment chamber, the seal chamber is configured so that the object can pass through the seal chamber in the horizontal direction, a passage having a rectangular cross-section is connected to an opening of the object loading opening and unloading opening of each seal chamber located on a side opposite to the heat treatment chamber, the passage is configured so that the object can pass through the passage in the horizontal direction, the object loading opening of the passage connected to the seal chamber object loading opening is the object loading opening of the heat treatment device, and the object unloading opening of the passage connected to the seal chamber object unloading opening is the object unloading opening of the heat treatment device, a pair of nozzles configured to eject the gas is provided at upper and lower positions of each passage, a gas ejection opening of each nozzle has a rectangular shape, in each passage, the pair of nozzles provided in the passage ejects the gas toward a center in the vertical direction of the passage, and toward the object loading opening or the object unloading opening of the heat treatment device included in the passage, in each passage, the gas ejection opening of each nozzle provided in the passage is parallel to a long-side direction of the loading opening and the unloading opening of the object of the passage and has a length equal to a length of the long side, and in each passage, a distance d between the gas ejection opening of the pair of nozzles provided in the passage and the object loading opening or the object unloading opening of the heat treatment device included in the passage, and a height Dn of the passage satisfy a relation of $2 \leq d < 0.75$ Dn, the method including:

setting a negative pressure in the seal chamber using the exhaust fan, and ejecting the gas from each nozzle so that a relation of $V \leq -30 \times P + 21$ is satisfied, when an amount of gas ejection of each nozzle provided in the passage per long side 1 m of the loading opening and the unloading opening of the object of the passage is expressed as V ($m^3/h$), and a gauge pressure in the seal chamber connected to the passage is expressed as P (Pa) in each passage.

It is preferred that a flow velocity Vo of the gas flowing into the seal chamber from each passage be 0.1 m/s or more and 0.5 m/s or less.

It is preferred that an ejection velocity Vs of the gas ejected from each nozzle be 3 m/s or more and 30 m/s or less.

In accordance with another aspect of the invention, there is provided a method of manufacturing a carbon fiber bundle having a step of manufacturing a flame-resistant fiber bundle by the method of manufacturing the flame-resistant fiber bundle, and a step of carbonizing the flame-resistant fiber bundle.

According to still another aspect of the invention, there is provided a heat treatment method of continuously heat-treating a continuous flat object using the horizontal heat treatment device.

Effect of the Invention

According to the invention, there is provided a heat treatment device that can prevent the cracked gas in the seal chamber such as the cracked gas from leaking to the outside, even if the amount of air curtain gas blowing toward the object is reduced.

In addition, there are provided a method of manufacturing a flame-resistant fiber bundle, a method of manufacturing the carbon fiber bundle, and a heat treatment method, using such a heat treatment device.

BRIEF DESCRIPTION OF DRAWINGS

FIG. 1 is a schematic diagram illustrating an example of an overall configuration of a heat treatment device according to an embodiment of the invention;

FIG. 2 is a schematic cross-sectional view of an air curtain unit in the embodiment of the invention;

FIG. 3 is an exploded perspective view of a nozzle portion of the air curtain unit;

FIG. 4 is a schematic cross-sectional view illustrating an overall configuration of a test device used in an example;

FIG. 5 is a graph illustrating a relation between an ejection velocity Vs and an internal pressure of a seal chamber in which a horizontal axis is the nozzle ejection wind velocity Vs and a vertical axis is the internal pressure of the seal chamber;

FIG. 6 is a graph illustrating a relation among a distance d, an ejection velocity Vs and the internal pressure of the seal chamber in which a horizontal axis is a distance d between nozzles 10*a* and 10*b* and a loading opening 11, and a vertical axis is the internal pressure of the seal chamber; and FIG. 7 is a block diagram of the heat treatment device for simulation performed in the example.

BEST MODE(S) FOR CARRYING OUT THE INVENTION

Hereinafter, embodiments of a horizontal heat treatment device of the invention will be described in detail with reference to the drawings. Here, as the horizontal heat treatment device, a horizontal oxidation oven will be described by way of an example. That is, the description will be given of a case where a continuous flat object is a carbon fiber precursor fiber bundle, and the horizontal heat treatment device is a oxidation oven that makes the carbon fiber precursor fiber bundle have flame resistance.

In addition, in this description, each of "upstream" and "downstream" refers to an upstream and a downstream in the conveying direction of the object.

As illustrated in FIG. 1, a heat treatment device (horizontal oxidation oven) 1 has a heat treatment chamber 2, seal chambers 4 and 4 that are each connected to the heat treatment chamber, and passages 19 and 19' having a rectangular cross-section that are each connected to the seal chambers 4 and 4. The heat treatment device is configured so that object can be transported in the order of the passage 19, the seal chamber 4 (upstream side), the heat treatment chamber 2, the seal chamber 4 (downstream side), and the passage 19'. An inlet (an opening of the upstream side) of the passage 19 is an object inlet (a heat treatment device loading opening 11) of the heat treatment device, and an outlet (an opening of the downstream side) of the passage 19' is an object outlet (a heat treatment device unloading opening 11') of the heat treatment device. That is, each passage has only one of the object loading opening (11) of the heat treatment device and the object unloading opening (11') of the heat treatment device.

The heat treatment device 1 is provided with the box-shaped heat treatment chamber 2. A hot air circulation device (not illustrated) configured to circulate the hot air through the heat treatment chamber portion is connected to the heat treatment chamber 2. It is possible to heat the object by the hot air to perform the heat treatment. As an example of the case of carbon fiber, the heat treatment device continuously performs the heat treatment of the precursor fiber made of, for example, polyacrylonitrile fiber within heat treatment chamber. At this time, a cracked gas such as cyanide, ammonia, and carbon monoxide is generated in the heat treatment chamber by oxidation reaction of the precursor fiber. It is necessary to recover the cracked gas and perform the gas treatment, such as the combustion process.

An exhaust port 20 is provided in the heat treatment chamber 2. The exhaust port 20 is connected to a fan 14 via an exhaust passage 21. In the middle of the exhaust passage 21, for example, a flow rate control mechanism 13 such as a valve is provided. The fan 14 is connected to an external gas recovery processing device (not illustrated).

(Seal Chamber)

Seal chambers 4 and 4 are continuously provided on outer walls (two side walls facing each other) 3 and 3 of the upstream side and the downstream side (illustrated both left and right sides) of the heat treatment chamber 2, respectively. The seal chambers 4 and 4 set the negative pressure in the chamber and recover the cracked gas so as to prevent the cracked gas generated in the furnace from leaking to the outside of the heat treatment device from the loading opening/the unloading opening of the precursor fiber bundle of the heat treatment device. The seal chamber may have a box shape.

Slit-like openings (a seal chamber outer wall loading opening 7 as an opening for loading the object into the seal chamber, and a seal chamber outer wall unloading opening 7' as an opening for unloading the object from the seal chamber) for loading/unloading the object, for example, a precursor fiber bundle A made of a polyacrylonitrile fiber bundle, are provided on the outer walls 5 and 5 (an upstream side wall of an upstream box-shaped seal chamber, and a downstream side wall of an downstream box-shaped seal chamber) of the seal chambers 4 and 4. Similarly, a loading opening 6 and an unloading opening 6' each corresponding to the seal chamber outer wall loading opening 7 and the seal chamber outer wall unloading opening 7' are also provided on the heat treatment chamber outer walls 3 and 3.

In other words, the seal chambers 4 and 4 are provided on the object inlet (the loading opening 6) side and the outlet (the unloading opening 6') side of the heat treatment chamber 2, respectively.

As the object, it is possible to use a long sheet-like material having a width in a depth direction of the drawings. When the object is a carbon fiber precursor fiber bundle, it is possible to arrange a plurality of the precursor fibers in the depth direction of the drawings, and to supply the object to the heat treatment device as the sheet-like material while being aligned in a sheet shape as a whole.

In the interior of the seal chambers 4 and 4, a partition plate 12 configured to each divide the seal chambers 4 and 4 into three separate partitions 4*a*, 4*b*, and 4*c* in the vertical direction are provided. Furthermore, the seal chambers 4 and 4 are provided with exhaust ports 15 and 15, and are connected to the exhaust fans 17 and 17 via the exhaust passages 22 and 22. In the middle of the exhaust passages 22 and 22, for example, a flow rate control mechanism 16 such as a valve is provided. The exhaust port 15 is provided in each of the partitions 4*a*, 4*b*, and 4*c*.

In the above-described heat treatment device, by partitioning the seal chambers 4 and 4 by the partition plate 12 respectively, (or by providing the exhaust port 15 and the flow rate control mechanism 16 for each partition), the pressure in each partition can be appropriately adjusted, it is possible to individually control the pressure difference of each partition of the heat treatment chamber and the seal chamber, and it is possible to control the inflow of outside air into the heat treatment chamber due to the influence of a buoyancy difference between the interior and the exterior of the heat treatment chamber, and the outflow of hot air from the same heat treatment chamber.

It is effective to partition the seal chamber, particularly, when the heat treatment device is configured so as to be able to transport the object in the horizontal direction, at a plurality of different positions in the vertical direction, respectively. In such a case, it is possible to provide the passages 19 and 19' at the plurality of different positions in the vertical direction, respectively. At this time, it is possible to partition the seal chamber so as to correspond to each of the passages provided at the plurality of different positions in the vertical direction. The heat treatment device illustrated in FIG. 1 is configured so as to be able to transport the object in the horizontal direction at the three different positions in the vertical direction, three passages are provided on each of the upstream side and the downstream side of the heat treatment device, and thereby the seal chamber is partitioned into three parts.

Furthermore, it is possible to use an exhaust adjusting mechanism that adjusts the engine speed of the exhaust fan, that is, the displacement, by comparing the internal pressure of each seal chamber to the internal pressure of the heat treatment chamber. Furthermore, in some cases, the heat treatment device is provided with a unit configured to detect a change in the internal pressure for automation, and a control unit configured to adjust the displacement of the exhaust regulating mechanism by the detection signal from the detection unit.

In general, the pressure difference between the pressure inside the heat treatment chamber and the pressure (pressure of outside air) outside the heat treatment chamber changes in the height direction of the heat treatment chamber, by the influence of the buoyancy difference between the interior and the exterior of the heat treatment chamber caused by the difference in the gas temperature. That is, the pressure difference between the interior and the exterior of the heat treatment chamber is large at the top of the heat treatment chamber, and the pressure difference between the interior and the exterior is small at the bottom of the heat treatment chamber.

(Air Curtain Unit)

A pair of pressure chambers 9*a* and 9*b* is vertically provided so as to interpose the seal chamber outer wall loading opening 7 therebetween. Furthermore, the pair of pressure chambers 9*a* and 9*b* is vertically provided so as to interpose the seal chamber outer wall unloading opening 7' therebetween. The pressure chamber is a box-shaped chamber that is pressurized by supply of air outside the heat treatment device. A single air supply duct 23 (having a branch pipe for supplying the air to each pair of the pressure chamber) illustrated in FIG. 2 is connected to the entire upstream pressure chamber, and is further connected to an air supply fan (not illustrated) via a common gas supply passage (not illustrated). Furthermore, another single supply duct is also connected to the entire downstream pressure chamber, and is connected to the air supply fan (not illustrated) via a common gas supply line (not illustrated). In addition, air as the gas supplied to the pressure chamber (gas ejected from the nozzle of the air curtain unit), in particular, the air outside the heat treatment device is described as an example, but it is also possible to use gas other than air.

The passages are provided on the side of the object inlet side and the outlet side of each seal chamber located on the opposite side to the heat treatment chamber (the passage 19 is located on the loading opening 7 side of the upstream seal chamber, and the passage 19' is located on the unloading opening 7' side of the downstream seal chamber). Specifically, the passage 19 configured to send the object (precursor fiber bundle A) is provided so as to extend from the seal chamber outer wall loading opening 7 to the heat treatment device loading opening 11 toward the outside (upstream side). Furthermore, the passage 19' configured to send the object is provided so as to extend from the seal chamber outer wall loading opening 7' to the heat treatment device unloading opening 11' toward the outside (downstream side).

A pair of rectangular nozzles is provided at the upper and lower positions (pressure chambers 9*a* and 9*b*) of each passage. The nozzles eject the air toward the center in the vertical direction of the passage, and toward the opening (the heat treatment device loading opening 11 in the passage 19, and the heat treatment device unloading opening 11' in the passage 19') located on the opposite side to the seal chamber of the object inlet and outlet of the passage. A gas flow rate control mechanism (for example, a flow rate control valve) capable of adjusting an amount of gas ejection for each nozzle is provided. Specifically, at the upper and lower positions of the passage 19 with the precursor fiber bundle A interposed therebetween, in order to suppress the flow rate of outside air flowing into the heat treatment device from the outside of the heat treatment device, a pair of slit-like nozzles 10*a* and 10*b* (nozzles of the air curtain unit) configured to eject air toward the center in the vertical direction of the passage and toward the opening of the heat treatment device loading opening 11 is provided. Furthermore, at the upper and lower positions of the passage 19' with the precursor fiber bundle A interposed therebetween, in order to suppress the flow rate of outside air flowing into the heat treatment device from the outside of the heat treatment device, a pair of slit-like nozzles 10*a*' and 10*b*' (nozzles of the air curtain unit) configured to eject air toward the center in the vertical direction of the passage and toward the opening of the heat treatment device unloading opening 11' is provided. In addition, in the specification, the "nozzle" refers to a gas flow path having a rectangular cross-section (for example, an air passage).

By the pressure chambers 9*a* and 9*b*, the nozzles 10*a* and 10*b*, and the passage 19 of the upstream side, on the outer side (upstream side) of the seal chamber outer wall loading opening 7, the air curtain unit 8 (upstream side) configured to suppress the inflow of outside air by blowing the air outside the heat treatment device is formed. Furthermore, by the pressure chambers 9*a* and 9*b*, the nozzles 10*a*' and 10*b*', and the passage 19' of the downstream side, on the outer side (downstream side) of the seal chamber outer wall loading opening 7', the air curtain unit 8 (downstream side) is formed. The nozzles 10*a*, 10*b* and 10*a*', 10*b*' extend in a direction perpendicular to the conveying direction of the object (a sheet depth direction in FIGS. 1 and 2).

In each passage, the nozzles are parallel to the long-side direction of the loading opening and the unloading opening of the object of the passage, and have the same length as the length of the long side. That is, in each passage, the loading opening and the unloading opening of the passage have a rectangular shape (the same rectangular shape as the cross-section of the passage), the long sides (sides in the sheet depth direction in FIG. 1) of the inlet and outlet of the passage are parallel to each other, and the nozzles (especially, the long sides of the gas ejection openings of the nozzles) are disposed in parallel with these long sides. The long sides of the passage inlet and outlet have the same length with each other, and the long sides of the passage inlet and outlet are the same as the length of the nozzles (especially, the length of the long side of the gas ejection opening of the nozzle).

To be more specific with respect to the passage 19, both the heat treatment device loading opening 11 and the seal chamber outer wall loading opening 7 have a rectangular shape (the same rectangular shape as the cross-section of the passage 19), and the long sides of the loading opening 11 and the loading opening 7 are parallel to each other. The nozzles 10*a* and 10*b* are disposed in parallel with the long sides of the loading opening 11 and the loading opening 7 (especially, the long sides of the gas ejection openings of the nozzles). The long sides of the loading opening 11 and the loading opening 7 have the same length with each other, and the lengths of the nozzles 10*a* and 10*b* (especially, the length of the long sides of the gas ejection openings of the nozzles) are the same as the lengths of the long sides of the loading opening 11 and the loading opening 7. The same is also true for the passage 19' (in this case, in the above description of the passage 19, the heat treatment device loading opening 11 is replaced with the heat treatment device unloading opening 11', the seal chamber outer wall loading opening 7 is replaced with the seal chamber outer wall unloading opening 7', and the nozzles 10*a* and 10*b* are replaced with the nozzles 10*a*' and 10*b*', respectively).

The seal chamber becomes the negative pressure, and the gas is ejected from the nozzles. The direction of ejection is a direction toward the center in the vertical direction of the passage, and toward the heat treatment device loading opening or the heat treatment device unloading opening located on the opposite side to the seal chamber of the object loading opening and unloading opening of the passage. Furthermore, at this time, it is preferred to uniformly eject the gas in parallel to the long side direction of the loading opening and the unloading opening of the object of the passage over the length of the long side. It is preferred that an amount of ejection V ($m^3$/h) of the gas ejected from the nozzles per 1 m in the long side direction of the passage cross-section and the pressure P (Pa) of the seal chamber connected to the passage satisfy the following formula.

$$V \leq -30 \times P + 21$$

The reason is that it is possible to reduce the amount of ejection of the gas ejected from the nozzles and control an amount of inflow of the airflow into the seal chamber. In addition, unless otherwise specified, the pressure is represented as a gauge pressure. Since the amount of ejection of gas V is an amount of ejection per 1 m in the long side direction of the passage cross-section, the unit is strictly "$m^3$/h/m", but "$m^3$/h" is used for simplicity.

In addition, the seal chamber has the negative pressure, and the amount of ejection V ($m^3$/h) of the gas ejected from the nozzles per 1 m in the long side direction of the passage cross-section is preferably 21 $m^3$/h or more.

By ejecting the gas from the nozzles in this way, it is possible to uniformly control the flow rate of the outside air flowing into the heat treatment device from the outside of the heat treatment device in the long side direction of the passage.

Furthermore, it is preferred that the ejection velocity Vs of the gas ejected from the nozzles be 3 m/s or more and 30 m/s or less. If the ejection velocity Vs is 3 m/s or more, the outside air flow flowing into the interior from the exterior of the heat treatment device is easily and uniformly controlled in the long side direction of the passage. If the ejection velocity Vs is 30 m/s or less, the object flutters, and it is easy to reduce a decrease in quality due to friction between the objects or between the devices. From the viewpoint of cost reduction, the ejection velocity Vs is preferably 15 m/s or less, more preferably is 10 m/s or less, and even more preferably is 5 m/s or less.

It is preferred that the flow velocity of the gas introduced into the seal chamber 4 from the passage be 0.1 m/s or more and 0.5 m/s or less. If the flow rate of the introduced gas is 0.1 m/s or more, it is easy to uniformly control the flow rate of the outside air flowing into the interior from the exterior of the heat treatment device in the long side direction of the passage, and if the flow velocity is 0.5 m/s or less, it is easy to suppress an increase in the exhaust gas due to the inflow of the outside air.

(Air Curtain Unit Nozzle Position)

In each passage, when a distance between the gas ejection openings of the pair of nozzles and the opening of the passage located on the opposite side to the seal chamber (the heat treatment device loading opening or the heat treatment device unloading opening) is assumed to be d and a height of the passage is assumed to be Dn, it is preferred that a relation of $2 \leq d < 0.75$ Dn be satisfied. When satisfying the relation of $2 \leq d < 0.75$ Dn, even if there is a little amount of ejection ejected from the nozzles, it is easy to control an amount of inflow of the gas into the seal chamber. Specifically, from the viewpoint of preventing the leakage of the gas (for example, the cracked gas) from the seal chamber, and from the viewpoint of suppressing the gas flowing from the outside to reduce the amount of gas ejected from the gas ejection opening, the distance between the gas ejection openings of the pair of nozzles 10*a* and 10*b* and the heat treatment device loading opening 11 of the upstream side, and the distance between the gas ejection openings of the pair of nozzles 10*a*' and 10*b*' and the heat treatment device unloading opening 11' of the downstream side is preferably 2 mm or more, more preferably is 7 mm or more, and even more preferably is 15 mm or more, respectively. Furthermore, the relation of $d < 0.73$ Dn is preferable, and the relation of $d < 0.70$ Dn is more preferable. Here, in this case, the distance between the heat treatment device loading opening 11 and the air ejection opening of the nozzle 10*a* is assumed to be the same as the distance between the heat treatment device loading opening 11 and the air ejection opening of the nozzle 10*b* (this is preferable, but is not limited thereto). Furthermore, the distance between the heat treatment device unloading opening 11' and the air ejection opening of the nozzle 10*a*' is assumed to be the same as the distance between the heat treatment device unloading opening 11' and the air ejection opening of the nozzle 10*b*' (this is preferable, but is not limited thereto). The distance of the loading opening side and the distance of the unloading opening side may be independently determined to each other.

Furthermore, it is preferred that the height Dn of the passage be 20 mm or more and 78 mm or less. If the passage height Dn is 20 mm or more, the object and the passage are hard to come into contact with each other, it is easy to reduce the degradation of quality, and if the passage height Dn is 78 mm or less, an increase in the size of the facility is suppressed and thus it is easy to suppress the investment costs.

It is preferred that an opening width Wn of the nozzle be 0.5 mm or more and 3 mm or less. If the opening width Wn is 0.5 mm or more, it is easy to secure the nozzle clearance, and if the opening width Wn is 3 mm or less, it is possible to reduce the flow rate of ejection from the nozzles, and it is easy to control the ejection wind velocity. Here, as illustrated in FIG. 4, the nozzle opening width Wn is defined as a width of a projected opening (length in a plane parallel to the sheet surface in FIG. 4) when the opening of the nozzle is projected onto the plane perpendicular to the flow direction of the gas flowing through the nozzle.

(Nozzle Structure)

In FIG. 2, the pressure chambers 9*a* and 9*b* are pressurized by supplying the air outside the heat treatment device from the air supply duct 23. Furthermore, the nozzle 10*a* provided in the pressure chamber 9*a* of the air curtain unit 8 is formed by an upper passage member (front member) 24 and an upper passage member (rear member) 25. Similarly, the nozzle 10*b* provided in the pressure chamber 9*b* is formed by a lower passage member (front member) 24' and a lower passage member (rear member) 25'.

The passage through which the object sent from the heat treatment device loading opening 11 is transported is formed by the upper passage member, the lower passage member, and the lateral surface members, and is interposed by the upper passage member and the lower passage member. Each of the upper and lower passage members is formed by the two members (the upper passage member is formed by the front member 24 and the rear member 25, and the lower passage member is formed by the front member 24' and the rear member 25') with the nozzles interposed therebetween as illustrated in FIG. 3. Similarly, the passage through which the object sent from the heat treatment device unloading opening 11' is transported is also formed by the upper passage member, the lower passage member, and the lateral surface member, and is interposed by the two upper and lower passage members. It is possible to integrate (fix) the two members (the front member and the rear member) by a removable locking member such as a bolt (not illustrated) with a spacer member 30 for determining the nozzle gap interposed between the two members.

By providing such an assembly structure, it is possible to reduce the manufacturing cost. Furthermore, it is possible to decompose the nozzle portion, which makes it easy to perform the maintenance work.

Furthermore, the front member is fixed to the air curtain unit by a front member fixing rail 26 formed by a plate extending in a direction perpendicular to the object (the sheet depth direction in FIG. 2) so as to fix its position. The rear member is fixed to the air curtain unit by a gap between the two plates of the two parallel plates (rear member fixing rail 27) extending in the direction perpendicular to the object (sheet depth direction in FIG. 2) so as to fix its position.

Next, an operation of this embodiment will be described.

As illustrated in FIG. 1, a plurality of precursor fiber bundles A is sent into the heat treatment device (in particular, the air curtain unit 8 of the loading side) from the uppermost heat treatment device loading opening 11 of the seal chamber 4 on the left side of the heat treatment device 1, in a state of being aligned in parallel to the direction perpendicular to the sheet. Next, the precursor fiber bundle passes through the seal chamber outer wall loading opening 7 of the outer wall 5 of the seal chamber 4 and the loading opening 6 of the outer wall 3 of the heat treatment chamber 2, and is sent out of the unloading opening 6' of the opposite outer wall 3 of the heat treatment chamber 2. Furthermore, the precursor fiber bundle A passes through the unloading opening 7' of the outer wall 5 of the seal chamber 4 connected to the heat treatment chamber 2, and is sent to the outside of the heat treatment device 1 through the air curtain unit 8 (unloading side). The precursor fiber bundle A sent to the outside of the heat treatment device 1 is turned back so as to be wound around a roll 18 provided outside the heat treatment device, and is sent into the heat treatment device 1 again from the loading opening just below the unloading opening 7' through which the bundle is sent out.

The precursor fiber bundle A sent into the heat treatment device 1 again is sent to the outside of the heat treatment device 1 via the same path in the opposite direction, is wound around the roll 18 provided outside the heat treatment device 1 again, and is turned back. Thus, the precursor fiber bundle A passes through the interior of the heat treatment device 1 so as to be repeatedly sent into, sent out, and meander in the heat treatment device 1, while being repeatedly turned back by the rolls 18 at the exterior of the heat treatment device 1. At this time, power is applied to the precursor fiber bundle A by the rotation of the roll 18 and friction of the surface of the roll 18, and is continuously sent in a direction of arrow X in FIG. 1.

Meanwhile, the hot air is circulated by a hot air circulation device (not illustrated) inside the heat treatment chamber 2, and is kept at a temperature of for example, 200° C. to 300° C. Thus, the precursor fiber bundle A continuously and repeatedly sent in the heat treatment chamber 2 is gradually subject to the heat treatment within the heat treatment chamber 2. At this time, the cracked gases such as cyanide, ammonia, and carbon monoxide is generated in the heat treatment chamber 2 by the oxidation reaction of the precursor fiber bundle A. The gas in the heat treatment chamber is sent by the exhaust fan 14, and is recovered and processed by an external gas recovery processor. Furthermore, the adjustment of the displacement of the generated cracked gas from the exhaust port 20 provided in the heat treatment chamber 2 can be performed by the flow rate control mechanism 13, for example, such as a valve.

Furthermore, the interior of the seal chambers 4 and 4 becomes the negative pressure by sucking the inside gas by the exhaust fans 17 and 17. Furthermore, in the heat treatment chamber 2, the pressure distribution in the vertical direction in which the top becomes a high pressure and the bottom becomes a low pressure occurs by being heated. Here, depending on the pressure distribution in the vertical direction of the heat treatment chamber 2, the pressure in each of the partitions 4*a* 4*b*, and 4*c* of the seal chambers 4 and 4 is adjusted to the pressure which can minimize the inflow of gas into the heat treatment chamber 2 from the seal chambers 4 and 4, or the outflow of the gas from the heat treatment chamber 2 into the seal chambers 4 and 4, and prevent the outflow of the gas within the seal chambers 4 and 4 to the outside from the loading opening 7 and the unloading opening 7' of the seal chambers 4 and 4.

Furthermore, in order to suppress the inflow of outside air into the seal chambers 4 and 4, which has become the negative pressure, the air outside the heat treatment device 1 is supplied to the upper and lower pressure chambers 9*a* and 9*b* of the air curtain unit 8, and the air is ejected toward the precursor fiber bundle A from the nozzles 10*a* and 10*b* and the nozzles 10*a'* and 10*b'* on the outer side of the seal chambers 4 and 4, thereby forming the air curtain. At this time, the air is ejected toward the loading opening 11 from the nozzles 10*b* and 10*a*. Furthermore, the air is ejected toward the unloading opening 11' from the nozzles 10*a'* and 10*b'*.

At this time, the distance d between the nozzles 10*a* and 10*b* and the loading opening 11, and the distance d (mm) between the nozzles 10*a'* and 10*b'* and the unloading opening 11' are preferably $2 \leq d < 50$, and more preferably is $15 \leq d \leq 30$. When the distance d is set within the above-described range, it is possible to reliably prevent the leakage of the cracked gas from the seal chamber, and to reduce the amount of blow-off air of the nozzle for securing the sealing properties. In addition, the distance between the nozzle 10*a* and the loading opening 11, the distance between the nozzle 10*b* and the loading opening 11, the distance between the nozzle 10*a'* and the unloading opening 11', and the distance between the nozzle 10*b'* and the unloading opening 11' are assumed to be equal to one another.

The nozzle 10*a* is formed by the upper passage member (front member) 24 and the upper passage member (rear member) 25. Similarly, the nozzle 10*b* provided in the pressure chamber 9*b* is formed by the lower passage member (front member) 24' and the lower passage member (rear member) 25'.

As illustrated in FIG. 3, each of the upper and lower passage members is formed by two members with the nozzles interposed therebetween. It is possible to integrate (fix) the two members by a removable locking member such as a bolt (not illustrated), by interposing the spacer member 30 for determining the nozzle gap between the two members. This is because a reduction in the manufacturing cost is achieved, and the cleaning work and the maintenance work of the nozzles are easily performed.

The vertically and evenly distributed air is ejected from the upper and lower ejection openings of the leading ends of the nozzles 10*a* and 10*b* at the approximately same ejection velocity Vs, thereby forming the air curtain that collides with the precursor fiber bundle A from the top and the bottom. Here, in response to the pressure of the partitions 4*a*, 4*b*, and 4*c* of the seal chambers 4 and 4, the ejection velocity Vs of the air ejected from the nozzles 10*a* and 10*b* of each air curtain unit 8 is adjusted to the ejection velocity at which the gas does not flow to the outside from the seal chamber 4. The same is also true for the nozzles 10*a'* and 10*b'*.

According to the invention, it is possible to reduce the amount of air blow-off by the nozzles for ensuring the sealing properties, and to reduce the load of a blowing unit to the air curtain seal device.

It is possible to produce a flame-resistant fiber bundle by heat-treating the carbon fiber precursor fiber bundle by the above-described horizontal heat treatment device.

Furthermore, by manufacturing the flame-resistant fiber bundle by the manufacturing method of the flame-resistant fiber bundle and by carbonizing the obtained flame-resistant fiber bundle, it is possible to manufacture the carbon fiber bundle.

EXAMPLES

Examples of the invention will be described below, but the invention is not limited thereto.

Here, a structure of an optimal air curtain was derived by performing a simulation under various conditions using analysis software.

First, by paying attention to the flow of gas from the atmosphere to the interior of the seal chamber, a model provided in the air curtain device was simulated. A computational fluid dynamics (CFD method) was used as an analysis method, and GAMBIT (trade name, ANSYS Japan K. K., for making a mesh and a shape) and FLUENT (trade name, ANSYS Japan K. K., for analysis) were used as the analysis software.

Furthermore, a mesh count was set to approximately 1.5 million meshes, and the simulation was performed by a calculation time of approximately 3 hours/CASE.

FIG. 7 is a diagram illustrating the model used here. In this model, a passage (flow path that simulates the passage of the air curtain) 102 of the air curtain is connected a seal chamber (box that simulates the seal chamber) 101, and the passage is opened to an exterior (region that simulates the exterior) 104 of the heat treatment device. Nozzles (flow path that simulates the nozzle) 103*a* and 103*b* of the air curtain are provided on the top and bottom of the passage 102, respectively. Angles θ of the nozzle with respect to the horizontal plane were set to 30°, respectively. On the side of the seal chamber 101 opposite to the passage 102, a heat treatment chamber inlet 105 is provided.

As the conditions of simulation, the gas was air, the reference pressure was 101325 Pa (atmospheric pressure) at an absolute pressure, the air temperature was 25° C., and the outflow conditions to the outside of the heat treatment device were set to a free outflow.

The calculation was performed, by changing the distance between the heat treatment device loading opening 11 and the gas ejection openings of the nozzles 10*a* and 10*b* (in the model, the distance between the opening to the outside of the heat treatment device of the passage 102 and the gas ejection openings of the nozzles 103*a* and 103*b*) d within the range of 2 to 70 mm, by changing the passage height (in the model, the height of the passage 102) Dn within the range of 10 to 80 mm, and by changing the opening width (in the model, the opening width of the nozzles 103*a* and 103*b*) Wn of the nozzle within the range of 0.5 to 5 mm.

Example 1

The gas inflow velocity Vo into the seal chamber was calculated by setting the distance d to 10 mm, the passage height Dn to 20 mm, the nozzle opening width Wn to 1.1 mm, the nozzle chamber internal pressure P to −0.5 Pa, and the gas blow-off wind velocity Vs from the gas ejection opening of the nozzle to 3 m/s. Each condition and the gas inflow velocity into the seal chamber are illustrated in Table 1. In addition, in Tables 1, 2 and 4, the distance d is displayed as a "distance between the loading opening 11 and the nozzle", and the height passage Dn is displayed as an "opening height".

Example 2

The calculation was performed in the same manner as in Example 1 except that the distance d was set to 20 mm, and the passage height Dn was set to 30 mm.

Example 3

The calculation was performed in the same manner as in Example 1 except that the distance d was set to 25 mm, and the passage height Dn was set to 40 mm.

Example 4

The calculation was performed in the same manner as in Example 1 except that the distance d was set to 50 mm, and the passage height Dn was set to 70 mm.

Example 5

The calculation was performed in the same manner as in Example 1 except that the nozzle blow-off wind velocity Vs was set to 4.5 m/s.

Comparative Example 1

The calculation was performed in the same manner as in Example 1 except that the distance d was set to 15 mm, and the passage height Dn was set to 20 mm. At this time, it was not possible to control the air inflow velocity into the seal chamber to 0.1 m/s or higher, and the gas blow-off to the outside of the heat treatment device from the seal chamber was confirmed. There was no such blow-off in the examples.

Comparative Example 2

The calculation was performed in the same manner as in Example 1 except that the distance d was set to 25 mm, and the passage height Dn was set to 30 mm. Similarly to Comparative Example 1, it was not possible to control the air inflow velocity into the seal chamber to 0.1 m/s or higher, or the blow-off was confirmed.

Comparative Example 3

The calculation was performed in the same manner as in Example 1 except that the distance d was set to 30 mm, and the passage height Dn was set to 40 mm. Similarly to Comparative Example 1, it was not possible to control the air inflow velocity into the seal chamber to 0.1 m/s or higher, or the blow-off was confirmed.

TABLE 1

| | Example 1 | Example 2 | Example 3 | Example 4 | Example 5 | Comparative Example 1 | Comparative Example 2 | Comparative Example 3 |
|---|---|---|---|---|---|---|---|---|
| Distance d between loading opening 11 and nozzle (mm) | 10 | 20 | 25 | 50 | 50 | 15 | 25 | 30 |
| Opening height Dn (mm) | 20 | 30 | 40 | 70 | 70 | 20 | 30 | 40 |
| Opening width Wn (mm) | 1.1 | 1.1 | 1.1 | 1.1 | 1.1 | 1.1 | 1.1 | 1.1 |
| Seal chamber internal pressure (Pa) | −0.5 | −0.5 | −0.5 | −0.5 | −0.5 | −0.5 | −0.5 | −0.5 |
| Nozzle blow-off wind velocity Vs (m/s) | 3 | 3 | 3 | 3 | 4.5 | | Non-adjustable | |
| Inflow velocity in seal chamber Vo (m/s) | 0.104 | 0.108 | 0.12 | 0.753 | 0.153 | | | |
| Flow rate per unit length V (m3/h) | 23.8 | 23.8 | 23.8 | 23.8 | 35.6 | | | |

Example 6

The gas blow-off velocity Vs (m/s) from the gas ejection opening of the nozzle and the gas blow-off flow velocity V ($m^3$/h) from the nozzle per 1 m in the width direction of the object were calculated so that the gas inflow velocity Vo into the seal chamber is 0.2 m/s, and the gas is not ejected to the outside of the heat treatment device from the passage, when the distance d is 20 mm, the passage height Dn is 30 mm, the nozzle opening width Wn is 1.1 mm, and the pressure P in the seal chamber is −2, −5, and −10 Pa, respectively.

Example 7

The calculation was performed in the same manner as in Example 6 except that the passage height Dn was 40 mm.

Example 8

The calculation was performed in the same manner as in Example 6 except that the passage height Dn was 70 mm.

Example 9

The calculation was performed in the same manner as in Example 6 except that the passage height Dn was 80 mm.

Example 10

The calculation was performed in the same manner as in Example 7 except that the nozzle opening width Wn was 0.5 mm.

Example 11

The calculation was performed in the same manner as in Example 7 except that the nozzle opening width Wn was 2 mm.

Example 12

The calculation was performed in the same manner as in Example 7 except that the nozzle opening width Wn was 3 mm.

Example 13

The calculation was performed in the same manner as in Example 7 except that the nozzle opening width Wn was 4 mm.

Example 14

The calculation was performed in the same manner as in Example 7 except that the nozzle opening width Wn was 5 mm.

Comparative Example 4

The calculation was performed in the same manner as in Example 6 except that the passage height Dn was 10 mm. When the seal chamber internal pressure is −2, −5, and −10 Pa, the gas blow-off velocity Vs (m/s) from the gas ejection opening of the nozzle is adjusted to set the gas inflow velocity Vo into the seal chamber to 0.2 m/s, thereby being able to prevent the gas from being ejected to the outside of the heat treatment device from the passage. However, when the seal chamber internal pressure is −0.5 Pa and further minimizing the pressure, it is assumed that the gas is ejected to the outside of the heat treatment device.

Comparative Example 5

The calculation was performed in the same manner as in Example 6 except that the passage height Dn was 20 mm. When the seal chamber internal pressure is −2, −5, and −10 Pa, the gas blow-off velocity Vs (m/s) from the gas ejection opening of the nozzle is adjusted to set the gas inflow velocity Vo into the seal chamber to 0.2 m/s, thereby being able to prevent the gas from being ejected to the outside of the heat treatment device from the passage. However, when the seal chamber internal pressure is −0.5 Pa and further minimizing the pressure, it is assumed the gas be ejected to the outside of the heat treatment device.

TABLE 2

| | | Example 6 | Example 7 | Example 8 | Example 9 | Example 10 | Example 11 | Example 12 | Example 13 | Example 14 | Comparative Example 4 | Comparative Example 5 |
|---|---|---|---|---|---|---|---|---|---|---|---|---|
| Distance d between loading opening 11 and nozzle (mm) | | 20 | 20 | 25 | 20 | 20 | 20 | 20 | 20 | 20 | 20 | 20 |
| Opening height Dn (mm) | | 30 | 40 | 70 | 80 | 40 | 40 | 40 | 40 | 40 | 10 | 20 |
| Opening width Wn (mm) | | 1.1 | 1.1 | 1.1 | 1.1 | 0.5 | 2 | 3 | 4 | 5 | 1.1 | 1.1 |
| Nozzle blow-off | Seal chamber internal pressure P = −2 | 5.9 | 7.3 | 8.3 | 8.5 | 9.9 | 4.1 | 3.1 | 2.0 | 1.7 | 2.0 | 3.0 |

TABLE 2-continued

| | | Example 6 | Example 7 | Example 8 | Example 9 | Example 10 | Example 11 | Example 12 | Example 13 | Example 14 | Comparative Example 4 | Comparative Example 5 |
|---|---|---|---|---|---|---|---|---|---|---|---|---|
| wind velocity Vs (m/s) | Seal chamber internal pressure P = −5 | 9.0 | 10.5 | 11.2 | 13.9 | 15.0 | 8.2 | 6.6 | 4.9 | 3.4 | 4.8 | 7.0 |
| | Seal chamber internal pressure P = −10 | 12.4 | 14.4 | 16.1 | 17.7 | 28.2 | 10.5 | 9.3 | 8.6 | 7.7 | 7.4 | 9.5 |
| Flow rate per unit length V (m3/h) | Seal chamber internal pressure P = −2 | 46.8 | 57.4 | 65.4 | 67.5 | 35.6 | 59.3 | 50.7 | 56.4 | 62.1 | 15.7 | 24.1 |
| | Seal chamber internal pressure P = −5 | 71.4 | 83.3 | 88.9 | 110.0 | 54.0 | 118.7 | 143.5 | 140.5 | 121.9 | 38.0 | 55.2 |
| | Seal chamber internal pressure P = −10 | 98.3 | 114.3 | 127.8 | 139.8 | 101.6 | 151.2 | 200.4 | 248.5 | 277.5 | 58.3 | 75.0 |

In the following tests, the gas ejection velocity (velocity at which the air is ejected from the nozzles 10*a* and 10*b*) Vs, the distance d between the gas ejection openings of the nozzles 10*a* and 10*b* and the heat treatment device loading opening 11, and the gas inflow velocity Vo to the seal chamber from the seal chamber outer wall loading opening 7 were measured, using a test device 100 having a schematic structure having no heat treatment chamber 2 illustrated in FIG. 4, instead of the actual heat treatment furnace 1 illustrated in FIG. 1. The loading opening 6 and the seal chamber outer wall loading opening 7 of the seal chamber 4 had the opening length of 2000 mm (the length in the depth direction of FIG. 4) and the opening height of 40 mm, respectively, (thus, Dn=40 mm). The openings of the nozzles 10*a* and 10*b* had the opening length of 2000 mm (length in the depth direction of FIG. 4) and the opening width Wn of 1.1 mm. The angles θ of the nozzles 10*a* 10*b* with respect to the horizontal plane were 30°, respectively.

In addition, the inflow of gas into the seal chamber 4 from the seal chamber outer wall loading opening 7 or the outflow of gas from the seal chamber via the loading opening 7 was confirmed, by observing the direction of flow of smoke, using a smoke tester manufactured by Gas-Tech Co., Ltd. Furthermore, the nozzle ejection velocity Vs was also measured using Anemomaster 6071 anemometer (trade name) manufactured by Kanomax Group.

Furthermore, since it is difficult to directly measure the gas inflow velocity Vo, the displacement of the exhaust fan 17 and an amount of inflow from the loading opening 6 were measured using Anemomaster 6071 anemometer (trade name) manufactured by Kanomax Group, and the gas inflow velocity Vo was calculated from the difference therebetween. The pressure in the seal chamber 4 was measured using Manostar Gauge Micro Differential Pressure Gauge manufactured by Yamamoto Electric Works Co., Ltd.

Air ejected from the gas ejection openings of the nozzles 10*a* and 10*b* of the air curtain unit 8 is supplied from an air supply fan (not illustrated). In each nozzle ejection velocity Vs of the air curtain unit 8, the negative pressure was formed in the seal chamber by the exhaust fan 17, and the internal pressure of the seal chamber 4 was measured by Manostar Gauges installed at two locations on the sheet front side and the sheet rear side. At this time, the flow direction of the smoke was observed using a smoke tester in the seal chamber outer wall loading opening 7, and the nozzle ejection velocity from the gas ejection openings of the nozzles 10*a* and 10*b* was adjusted so that there is no outflow of gas from the seal chamber 4 in the entire width up to the furnace width direction (from the sheet front side to the sheet rear side). An example of a relation between the seal chamber internal pressures and the nozzle ejection velocity Vs suitable for each seal chamber internal pressure is illustrated in Table 3 and FIG. 5 below. In addition, the seal chamber internal pressure (unit: Pa) is represented by a gauge pressure. The distance d between the gas ejection openings of the nozzles 10*a* and 10*b* and the heat treatment device loading opening 11 at the time of obtaining the example illustrated in Table 3 was 20 mm.

[Table 3]

TABLE 3

| | Nozzle ejection velocity Vs (m/s) | | | |
|---|---|---|---|---|
| | 14.8 | 10.0 | 5.2 | 0 |
| Seal chamber internal pressure (pa) | −11.7 | −4.45 | −0.95 | 0 |

It is understood that as the internal pressure of the seal chamber 4 decreases from Table 3 and FIG. 5, it is necessary to increase the nozzle ejection velocity Vs.

Here, depending on the ejection velocity Vs of the air ejected from the gas ejection openings of the nozzles 10*a* and 10*b*, the distance d between the gas ejection openings of the nozzles 10*a* and 10*b*, and the heat treatment device loading opening 11 is adjusted.

Example 15

Similarly to the above-described tests, in this test, the test device 100 having the schematic structure illustrated in FIG. 4 was used. Both of the distance between the gas ejection opening of the nozzle 10*a* and the heat treatment device loading opening 11, and the distance between the gas ejection opening of the nozzle 10*b* and the heat treatment device loading opening 11 were set to 2 mm (d=2 mm), and the nozzle ejection wind velocity Vs was set to three conditions of 5.2, 9.96, and 14.8 m/s, by changing the supply amount of air to the nozzle. Under each of the nozzle ejection wind velocity conditions, the direction of flow of the smoke was observed using the smoke tester in the seal chamber outer wall loading opening 7, the exhaust fan 17 was adjusted so that there is no outflow of gas from the seal chamber 4 in the overall width up to the furnace width direction (from sheet front side to sheet rear side), and the internal pressure of the seal chamber 4 was measured by Manostar Gauge. Similarly to the above-described tests, Dn was 40 mm, Wn was 1.1 mm, the opening lengths of the heat treatment chamber outer wall loading opening 6 and the seal chamber outer wall unloading opening 7 were 2000 mm, the opening length of the nozzle opening was also 2000 mm, and the angles θ of the nozzle with respect to the horizontal plane were 30°.

Example 16

The measurement was performed in the same manner as in Example 15 except that the distance d between the gas ejection openings of the nozzles 10*a* and 10*b* and the heat treatment device loading opening 11 was 5 mm.

Example 17

The measurement was performed in the same manner as in Example 15 except that the distance d was 10 mm.

Example 18

The measurement was performed in the same manner as in Example 15 except that the distance d was 15 mm.

Example 19

The measurement was performed in the same manner as in Example 15 except that the distance d was 20 mm.

Example 20

The measurement was performed in the same manner as in Example 15 except that the distance d was 25 mm.

Example 21

The measurement was performed in the same manner as in Example 15 except that Dn was 30 mm and the distance d was 20 mm.

Comparative Example 6

The measurement was performed in the same manner as in Example 15 except that the distance d was 0 mm. At this time, when manufacturing the nozzles, processing is difficult in a case where the ejection openings of the nozzles are provided at the position of the distance d of 0 mm, and thus, the distance d is set to 2 mm or more.

Comparative Example 7

The measurement was performed in the same manner as in Example 15 except that the distance d was 30 mm. At this time, as a result of setting the seal chamber internal pressure in the nozzle blow-off wind velocity (Vs) of 5.2 m/s to −1.35 Pa and setting the gas inflow velocity (Vo) into the seal chamber to 0.2 m/s, the blow-off from a part of the loading opening 7 was confirmed. There was no blow-off in this example. This example illustrates that when the relation of d<0.75 Dn is not satisfied (d=0.75 Dn in this example), there is a location where the blow-off of the furnace gas is confirmed in a direction perpendicular to the conveying direction of the object, and the gas of the seal chamber 4 leaks to the outside of the heat treatment device 1 from the loading opening 7.

The results of Examples 15 to 21 and Comparative Examples 6 and 7 are illustrated in Table 4. Furthermore, the results of Examples 15 to 20 and Comparative Example 6 are illustrated in FIG. 6.

FIG. 6 illustrates a relation between the seal chamber internal pressure and the distance d that is able to achieve a target line of the gas inflow velocity Vo=0.2 m/s (a limit gas inflow velocity required for securing a state in which there is no blow-off of the furnace gas in a direction perpendicular to the conveying direction of the object), when the nozzle ejection wind velocity Vs is set under three conditions of 5.2, 9.96, and 14.8 m/s, and the distance d is changed as illustrated in Table 4 below by replacing the member 31 for adjusting the distance d between the gas ejection openings of the nozzles 10*a* and 10*b* and the heat treatment device loading opening 11. In the graph, a rhombic point represents data when the nozzle blow-off wind velocity Vs is set to 5.2 m/s, a rectangle point represents data when the nozzle blow-off wind velocity Vs is set to 9.96 m/s, and a triangular point represents data when the nozzle blow-off wind velocity Vs is set to 14.8 m/s.

As illustrated in FIG. 6, in the nozzle ejection wind velocity, the seal chamber internal pressure when adjusted to the target gas inflow velocity of approximately 0.2 m/s drops by an increase in d. This indicates that as long as the seal chamber internal pressure is the same, by further increasing d, it is possible to adjust the outside air inflow velocity by a smaller nozzle ejection wind velocity. The nozzle ejection wind velocity required to adjust the gas inflow velocity increases, especially, under the condition of d=0. From Table 4 and FIG. 6, at the same nozzle ejection wind velocity, the nozzle pressure when adjusted to the target gas inflow velocity of 0.2 m/s decreases as d becomes longer in a range of 2 mm or more, and this tendency is seen more significantly in a range in which d is 15 mm or more.

TABLE 4

| | | Example 15 | Example 16 | Example 17 | Example 18 | Example 19 | Example 20 | Example 21 | Comparative Example 6 | Comparative Example 7 |
|---|---|---|---|---|---|---|---|---|---|---|
| Distance d between loading opening 11 and nozzle (mm) | | 2 | 5 | 10 | 15 | 20 | 25 | 20 | 0 | 30 |
| Opening height Dn (mm) | | 40 | 40 | 40 | 40 | 40 | 40 | 30 | 40 | 40 |
| Opening width Wn (mm) | | 1.1 | 1.1 | 1.1 | 1.1 | 1.1 | 1.1 | 1.1 | 1.1 | 1.1 |
| Seal chamber internal pressure P (Pa) | Vs = 5.2 | −1 | −1 | −1.05 | −1.3 | −1.3 | −1.35 | −1.2 | −0.95 | Non-adjustable |
| | Vs = 9.96 | −4.1 | −4.15 | −4.45 | −4.65 | −4.95 | −5.2 | −4.9 | −4 | |
| | Vs = 14.8 | −11.3 | −11.3 | −11.4 | −11.6 | −11.7 | −11.8 | −12.9 | −11.2 | |

INDUSTRIAL APPLICABILITY

Meanwhile, the invention is not limited to the above-described embodiments. For example, it is possible to transport the precursor fiber bundle in one stage to dozens of stages depending on the situation.

EXPLANATIONS OF LETTERS OR NUMERALS

1: horizontal heat treatment device
2: heat treatment chamber
3: heat treatment chamber outer wall
4: seal chamber
5: outer wall of seal chamber
6: loading opening of heat treatment chamber outer wall

6': unloading opening of heat treatment chamber outer wall
7: seal chamber outer wall loading opening
7': seal chamber outer wall unloading opening
8: air curtain unit
9*a*, 9*b*: pressure chamber (upper and lower)
10*a*, 10*b*: loading side air curtain nozzle (upper and lower)
10*a*', 10*b*': unloading side air curtain nozzle (upper and lower)
11: heat treatment device loading opening
11': heat treatment device unloading opening
12: partition plate
13: flow rate control mechanism
14: exhaust fan
15: exhaust port
16: flow rate control mechanism
17: exhaust fan
18: roll
19: passage of loading side air curtain unit
19': passage of unloading side air curtain unit
20: exhaust hole
21: exhaust path
22: exhaust path
23: air supply duct
24: upper passage member (front member)
25: upper passage member (rear member)
24': lower passage member (front member)
25': lower passage member (rear member)
26: front member fixing rail
27: rear member fixing rail
30: spacer member
31: distance d adjusting member used in Example
100: test device used in Example
101: seal chamber
102: passage of air curtain
103: nozzle of air curtain
104: heat treatment device exterior
105: heat treatment chamber inlet
P: seal chamber internal pressure
Vs: gas blow-off wind velocity from nozzle
Vo: gas flow rate into seal chamber
A: precursor fiber bundle (bundle)
X: conveying direction of precursor fiber bundle
D: distance between nozzles 10*a* and 10*b* and loading opening 11
Dn: opening height of passage of air curtain unit
Wn: opening width of nozzle
θ: slope angle of nozzle with respect to horizontal plane

The invention claimed is:

1. A horizontal heat treatment device configured to continuously heat-treats a continuous flat object, while transporting the object within a heat treatment chamber in a horizontal direction, wherein a seal chamber connected to an exhaust fan is connected to each of object loading opening and unloading opening of the heat treatment chamber, and the seal chamber is configured so that the object can pass through the seal chamber in the horizontal direction, a passage having a rectangular cross-section is connected to an opening of the object loading opening and unloading opening of each seal chamber located on a side opposite to the heat treatment chamber, and the passage is configured so that the object can pass through the passage in the horizontal direction, the seal chamber is located between the heat treatment chamber and the passage, the object loading opening of the passage connected to the seal chamber object loading opening is an object loading opening of the heat treatment device, and the object unloading opening of the passage connected to the seal chamber object unloading opening is an object unloading opening of the heat treatment device, a pair of nozzles configured to eject gas is provided at upper and lower positions of each passage, a gas ejection opening of each nozzle has a rectangular shape, in each passage, the pair of nozzles provided in the passage ejects the gas toward a center in the vertical direction of the passage, and toward the object loading opening or the object unloading opening of the heat treatment device included in the passage, in each passage, the gas ejection opening of each nozzle provided in the passage is parallel to a long-side direction of the loading opening and the unloading opening of the object of the passage, and has a length equal to a length of the long side, and in each passage, a distance d, which is greater than 0, between the gas ejection opening of the pair of nozzles provided in the passage and the object loading opening or the object unloading opening of the heat treatment device included in the passage, and a height Dn of the passage satisfy a relation of $2\ \text{mm} \leq d < 0.75\ Dn$.

2. The horizontal heat treatment device according to claim 1, wherein in each passage, the distance d is 15 mm or more.

3. The horizontal heat treatment device according to claim 1, wherein in each passage, an opening width Wn of the nozzle is 0.5 mm or more and 3 mm or less, and the height Dn of the passage is 20 mm or more and 78 mm or less.

4. The horizontal heat treatment device according to claim 1, wherein the passages are each provided at multiple positions in the vertical direction so that the object can be transported in the horizontal direction at the multiple positions in the vertical direction, respectively, and the seal chamber is partitioned so as to correspond to each of the passages.

5. The horizontal heat treatment device according to claim 1, further comprising:

a gas flow rate control mechanism capable of adjusting an amount of ejection of gas for each nozzle.

6. The horizontal heat treatment device according to claim 1, wherein the passage is formed by an upper passage member, a lower passage member, and a lateral surface member, each of the upper and lower passage members has two members with the nozzle interposed therebetween, and the two members are integrated with a spacer member configured to determine a nozzle gap while interposing the spacer member therebetween.

7. The horizontal heat treatment device according to claim 1, wherein the two members and the spacer member are freely attachable and detachable.

8. The horizontal heat treatment device according to claim 1, wherein the device is a heat treatment furnace that heat-treats the carbon fiber precursor fiber bundle.

9. A method of manufacturing a flame-resistant fiber bundle that heat-treats a carbon fiber precursor fiber bundle by a horizontal heat treatment device to manufacture a flame-resistant fiber bundle, wherein the horizontal heat treatment device is a horizontal heat treatment device that continuously heat-treats a continuous flat object, while transporting the object within a heat treatment chamber in a horizontal direction, a seal chamber connected to an exhaust fan is connected to each of object loading opening and unloading opening of the heat treatment chamber, and the seal chamber is configured so that the object can pass through the seal chamber in the horizontal direction, a passage having a rectangular cross-section is connected to an opening of the object loading opening and unloading opening of each seal chamber located on a side opposite to the heat treatment chamber, and the passage is configured so that the object can pass through the passage in the horizontal direction, the seal chamber is located between the heat treatment chamber and the passage, the object loading opening of the passage connected to the seal chamber object loading opening is an object loading opening of the heat treatment device, and the object unloading opening of the passage connected to the seal chamber object unloading opening is an object unloading opening of the heat treatment device, a pair of nozzles configured to eject the gas is provided at upper and lower positions of each passage, a gas ejection opening of each nozzle has a rectangular shape, in each passage, the pair of nozzles provided in the passage ejects gas toward a center in the vertical direction of the passage, and toward the object loading opening or the object unloading opening of the heat treatment device included in the passage, in each passage, the gas ejection opening of each nozzle provided in the passage is parallel to a long side direction of the loading opening and the unloading opening of the object of the passage, and has a length equal to a length of the long side, and in each passage, a distance d, which is greater than 0, between the gas ejection opening of the pair of nozzles provided in the passage and the object loading opening or the object unloading opening of the heat treatment device included in the passage, and a height Dn of the passage satisfy a relation of $2\ mm \leq d < 0.75\ Dn$, the method comprising:

setting a negative pressure in the seal chamber using the exhaust fan; and ejecting the gas from each nozzle so that a relation of $V \leq -30 \times P + 21$ is satisfied, when an amount of gas ejection of each nozzle provided in the passage per long side 1 m of the loading opening and the unloading opening of the object of the passage is expressed as V ($m^3/h$), and a gauge pressure in the seal chamber connected to the passage is expressed as P (Pa) in each passage.

10. The method of manufacturing a flame-resistant fiber bundle according to claim 9, wherein a flow velocity Vo of the gas flowing into the seal chamber from each passage is set to 0.1 m/s or more and 0.5 m/s or less.

11. The method of manufacturing a flame-resistant fiber bundle according to claim 9, wherein an ejection velocity Vs of the gas ejected from each nozzle is set to 3 m/s or more and 30 m/s or less.

12. A method of manufacturing a carbon fiber bundle comprising:

a step of manufacturing a flame-resistant fiber bundle by the method of manufacturing the flame-resistant fiber bundle according to claim 9; and a step of carbonizing the flame-resistant fiber bundle.

13. A heat treatment method of continuously heat-treating a continuous flat object using the horizontal heat treatment device according to claim 1.

14. The method according to claim 9, further comprising:

dividing the seal chamber into a plurality of separate partitions by a plurality of partition plates, such that each of the separate partitions is provided with an exhaust port.

15. The method according to claim 14, further comprising:

individually controlling pressure difference of each of the partitions of the seal chamber; and controlling an inflow of outside air into the heat treatment chamber due to influence of a buoyancy difference between interior and exterior of the heat treatment chamber, and an outflow of hot air from the heat treatment chamber.

16. The horizontal heat treatment device according to claim 1, wherein the seal chamber is divided into a plurality of separate partitions by a plurality of partition plates, such that each of the separate partitions is provided with an exhaust port.

* * * * *